US005297832A

United States Patent [19]

Dewey et al.

[11] Patent Number: 5,297,832

[45] Date of Patent: Mar. 29, 1994

[54] LOG LIFTING BEAM ASSEMBLY

[76] Inventors: Fred Dewey, R.D. 1 Box 468, Valatie, N.Y. 12184; Patrick Dewey, P.O. Box 132, Victory Mills, N.Y. 12884

[21] Appl. No.: 1,537

[22] Filed: Jan. 7, 1993

[51] Int. Cl.[5] ..... B66C 1/12

[52] U.S. Cl. ..... 294/81.55; 294/67.4; 294/74

[58] Field of Search ..... 294/67.4, 67.41, 74, 294/75, 81.2, 81.21, 81.3, 81.55, 81.56

[56] References Cited

U.S. PATENT DOCUMENTS

| | | | |
|---|---|---|---|
| 339,496 | 4/1886 | Temple . | |
| 808,493 | 12/1905 | Titcomb . | |
| 1,465,155 | 8/1923 | Brady . | |
| 1,834,902 | 12/1931 | Payzant | 294/81.55 X |
| 1,928,213 | 9/1933 | Showers, Jr. et al. | 294/81.2 |
| 2,006,871 | 7/1935 | Neuman . | |
| 2,101,839 | 12/1937 | Crawford . | |
| 2,792,130 | 5/1957 | Fetchko . | |
| 2,946,461 | 7/1960 | Slezak et al. | 294/81.55 X |
| 3,499,548 | 3/1970 | Kruse | 294/67.41 |
| 3,789,997 | 2/1974 | Kozlovsky et al. . | |
| 3,970,342 | 7/1976 | Cotton | 294/74 X |
| 4,114,765 | 9/1978 | Kojima | 294/81.55 X |
| 4,293,155 | 10/1981 | Grant | 294/75 |
| 4,756,431 | 7/1988 | Hirano . | |

FOREIGN PATENT DOCUMENTS

| | | | |
|---|---|---|---|
| 796155 | 1/1981 | U.S.S.R. | 294/67.3 |
| 1142419 | 2/1985 | U.S.S.R. | 294/81.2 |
| 1669849 | 8/1991 | U.S.S.R. | 294/81.55 |

*Primary Examiner*—Dean J. Kramer

*Attorney, Agent, or Firm*—Schmeiser, Morelle & Watts

[57] ABSTRACT

A crane operated log lifting beam assembly for unloading a tier of logs from a truck. The beam assembly includes two cable operated longitudinally displaceable trolley systems for securing an attached pulp sling against the tier of logs and a displacement equalizing system for interconnecting the trolley systems and for controlling the relative displacement thereof.

19 Claims, 5 Drawing Sheets

LOG LIFTING BEAM ASSEMBLY

FIELD OF THE INVENTION

The present invention relates to the logging industry and, more particularly, to a crane operated log lifting beam assembly for the unloading of logs from a truck. The invention includes an elongated beam containing two longitudinally displaceable trolley systems which are adapted to tighten an attached cable pulp sling against a tier of logs under the control of a crane operated hoist line.

BACKGROUND OF THE INVENTION

Pulp logs are generally transported to a wood yard located at a paper mill, lumber mill or the like aboard a vertical stake logging truck. Typically, the truck arrives at the wood yard carrying a load of logs which have been precut to a predetermined length such as four or eight feet and which have been arranged in a plurality of tiers along the length of the truck, with each tier weighing several tons depending upon the dimensions of the logs and the type of wood. Prior to the loading of each tier of logs onto the truck, a cable pulp sling is typically centered transversely thereunder with each end of the pulp sling being manually secured to a fastening element located on the upper section of an appropriate truck stake, in a position which cannot be accessed by workmen standing on the ground. Consequently, at least one workman is required to climb up on top of the logs, which are commonly wet, frozen and/or covered with ice, in order to secure the ends of each cable pulp sling to the corresponding fastening elements, thereby increasing the probability of accidental injury or death due to falls, slips, shifting logs or other hazards associated with the log loading process.

After arriving at the wood yard, each of the log tiers on the truck is unloaded by manually securing the ends of the associated pulp sling to a slip-hook arrangement located at the end of a crane operated hoisting cable. As the hoisting cable is raised upwards by the crane, the slip-hook arrangement tightens the attached pulp sling around the tier of logs, thereby enabling the tier to be lifted out of the truck and transferred to the appropriate location in the wood yard. Again, because of the inaccessible location of the ends of the cable pulp slings, at least one workman must climb up on top of each tier of logs to attach the corresponding pulp sling to the slip-hook arrangement. Depending upon the number of log tiers carried by the truck, a workman may be required to climb on and off the truck several times, thereby exacerbating the probability of accidental injury or death.

Workmen on the ground may also be injured while the log tiers are being unloaded from a truck and during the transfer of the unloaded logs t the appropriate section of the wood yard because of the inherent instability afforded by currently available crane operated log unloading systems. In particular, if a pulp sling has not been correctly centered under a tier of logs during the loading process, the logs may not be correctly balanced within the slip-hook arrangement and may not remain in a substantially horizontal orientation relative to the ground during the unloading process. Consequently, one or more logs may shift out of position, slide out from within the slip-hook arrangement and fall to the ground crushing any workmen or equipment unfortunate enough to be located thereunder.

SUMMARY OF THE INVENTION

In order to avoid the disadvantages of the prior art, the crane operated log lifting beam assembly of the present invention includes an elongated beam containing two longitudinally displaceable trolley systems for tightening an attached pulp sling against the underside of a tier of logs, thereby allowing the arrangement of logs to be lifted off a truck under the control of a crane, and a unique cabling/sheave system for controlling the displacement of the trolley systems along the elongated beam. The beam assembly includes a hoisting sling having two branches which are adapted to extend downwards from the elongated beam around opposite sides of a tier of logs which are to be unloaded from a truck. Advantageously, the end sections of the hoisting sling hang down the sides of the tier of logs to a point which is easily accessible to workmen standing on the ground, thereby allowing the end sections to be easily attached to opposite ends of the pulp sling which extends transversely under the tier of logs. Thus, the present invention drastically reduces the number of potential hazards facing the workmen who are unloading the logs from the truck because they are no longer required to climb on top of the logs to secure the ends of each pulp sling to a crane operated slip-hook arrangement. In addition, the logs are less likely to shift out of position and/or fall to the ground during the unloading process because the top portion of the log tier is generally clamped against the bottom of the elongated beam in response to the tightening of the pulp sling. Consequently, the additional clamping force of the logs against the bottom of the elongated beam may allow a tier of logs to be lifted off a truck even if the corresponding pulp sling has not been properly centered transversely thereunder; the logs are less likely to slip out and fall to the ground.

The substantially hollow elongated beam, which is formed from a high strength material such as steel or the like, includes longitudinally extending guides on opposing inner sides thereof for receiving the trolley systems, a vertically oriented hoisting sheave proximate each end thereof for receiving a branch of a cable operated hoisting sling, a vertically oriented release sheave proximate each end thereof for receiving a branch of a crane operated release sling, a horizontally oriented equalizing sheave proximate each end thereof for receiving a trolley displacement equalizing cable and stop elements for controlling the outward longitudinal displacement of the trolley systems. In the preferred embodiment, the hoisting and release sheaves are adapted to rotate about an axis which is parallel to the transverse axis of the beam, while the equalizing sheaves are adapted to rotate about an axis parallel to the vertical axis of the beam.

Each of the trolley systems include a plurality of side mounted wheels which are adapted to rotate along the longitudinally extending guides within the elongated beam in response to the crane operated manipulation of the hoisting and release slings, a vertically oriented trolley sheave for receiving the hoisting sling, and connecting elements for securing the release sling and an equalizing cable thereto. In the preferred embodiment of the invention, the trolley systems may be substantially symmetrically arranged within distinct end sections of the elongated beam, wherein a first trolley system may be longitudinally displaced within a first end section of the elongated beam and the second trolley system may be longitudinally displaced within a second end section of the elongated beam.

The hoisting sling, which is operatively connected proximate a middle portion thereof to a crane operated hoisting cable by an oblong linking element or the like, includes two branches which are adapted to be attached to opposite ends of a thimble and thimble wire rope or similar type cable pulp sling which has been transversely positioned under a tier of logs on a truck. Preferably, each branch of the hoisting sling includes a hook-type element or other appropriate hardware which may be removably secured to one end of the pulp sling. In particular, unlike the prior art log unloading systems, the ends of the pulp sling may be secured to a fastening element which is strategically located on a lower section of the truck or left hanging down the sides thereof within easy reach of workmen standing on the ground. Consequently, the workmen can secure the hook-type elements located on each end of the first and second branches of the hoisting sling to opposite ends of the pulp sling without having to climb up on top of the tier of logs. A first branch of the hoisting sling runs under the hoisting sheave located proximate the first end section of the elongated beam, passes through the beam, runs over the trolley sheave on the second trolley system which is located within the second, opposite end section of the beam, and exits through the bottom of the beam where it may be secured to one end of a pulp sling. Similarly, the second branch of the hoisting sling runs under the hoisting sheave located proximate the second end section of the beam, passes through the beam in a direction substantially opposite to that of the first branch of the hoisting sling, runs over the trolley sheave on the first trolley system which is located within the first end section of the beam, and exits through the bottom of the beam where it may be fastened to the other end of the pulp sling. In operation, the attached pulp sling and the two branches of the hoisting sling are tightened against the bottom and sides of the tier of logs, respectively, in response to the upward movement of the crane operated hoisting cable. In particular, as the beam assembly is elevated, the weight of the logs within the pulp sling forces the two branches of the hoisting sling against their respective trolley sheaves, thereby applying an inwardly directed pressure thereagainst and forcing the first and second trolley systems toward each other along the longitudinally extending guides within the elongated beam.

The release sling, which is operatively connected proximate a central portion thereof to a crane operated release cable by a linking element, includes a first branch which is fastened to the first trolley system and a second branch which is fastened to the second trolley system. In particular, the first branch of the release sling runs under the release sheave located within the first end section of the beam and is fastened to the first trolley system. Analogously, the second branch of the release sling runs under the release sheave located within the second end section of the beam and is connected to the second trolley system. In operation, the first and second trolley systems are forced in opposite directions along the longitudinally extending guides, toward opposing end portions of the elongated beam, in response to the upward movement of the crane operated release cable. If required, a stop member may be provided to limit the outward longitudinal displacement of the trolley systems and to prevent the trolley systems from striking and/or damaging the outer end walls of the elongated beam as well as the hoisting and release sheaves.

The present invention utilizes a unique trolley displacement equalizing system for controlling the relative displacement of the trolley systems and for ensuring that the trolley systems will travel inward and outward substantially in unison along the longitudinally extending guides within the elongated beam, thereby maintaining the beam assembly in a substantially horizontal operational orientation. In the preferred embodiment of the invention, the equalizing system utilizes two equalizing cables to interconnect the two trolley systems. In particular, a first equalizing cable is secured to the first trolley system, runs around the equalizing sheave located within the first end section of the elongated beam, and is secured to the second trolley system. Similarly, the second equalizing cable runs around the equalizing sheave located within the second end section of the elongated beam and is fastened to the first and second trolley systems. Thus, for example, the inwardly directed displacement of the first trolley system, in response to the upward actuation of the crane operated hoisting cable, pulls the first equalizing cable around the equalizing sheave located within the first end section of the elongated beam, thereby pulling the second trolley system inward along the beam toward the first trolley system. Correspondingly, the outwardly directed displacement of the first trolley system, in response to the upward actuation of the crane operated release cable, pulls the second equalizing cable around the equalizing sheave located within the second end section of the elongated beam, thereby pulling the second trolley system outward along the beam away from the first trolley system. Consequently, the displacement of one of the trolley system along the elongated beam results in a substantially equivalent and oppositely directed displacement of the other trolley system along the beam.

In operation, a truck carrying at least one tier of logs, each of which have been loaded on top of a pulp sling, is positioned within the reach of a wood yard crane which has been operatively connected to the log lifting beam assembly of the present invention by the crane operated hoisting and release cables. The crane operator subsequently positions and lowers the log lifting beam assembly directly over one of the pulp slings until the bottom thereof comes into contact with the tier of logs. During the positioning process, the crane operator supports the weight of the beam assembly on the release cable, thereby moving the trolley systems against the stop elements located at each end of the beam, and applies a sufficient amount of upward tension against the hoisting cable to reduce the downwardly extending length of the first and second branches of the hoisting sling. After the beam assembly has been correctly positioned above the tier of logs, the crane operator lowers the hoisting cable, thereby lowering the two branches of the hoisting sling about opposite sides of the truck an positioning the hook-type element on each end thereof within a few feet of the ground. The hook-type elements, which are easily accessible to a workman standing on the ground, may then be easily secured to opposite ends of the pulp sling. After the pulp sling has been secured to the branches of the hoisting sling, the crane operator raises the hoisting cable while increasing the slack of the release cable, thereby forcing the two trolley systems together toward the center of the beam, tightening the pulp sling and the branches of the hoisting sling against the tier of logs and clamping the logs against the bottom of the beam assembly. The crane operator may then continue to take up the hoisting cable until the beam assembly and the tier of logs secured thereunder have been elevated to the desired height. After rotating the crane to position the beam assembly and logs over an appropriate area of the wood yard, the crane operator may take up the release cable and increase the slack of the hoisting cable, thereby forcing the two trolley systems toward their outermost positions within the beam and releasing the tier of logs, which subsequently fall to the ground. The crane operator may then return the crane to a position over the truck and repeat the above-described operation for each remaining tier of logs.

DETAILED DESCRIPTION OF THE INVENTION

Figure 1:
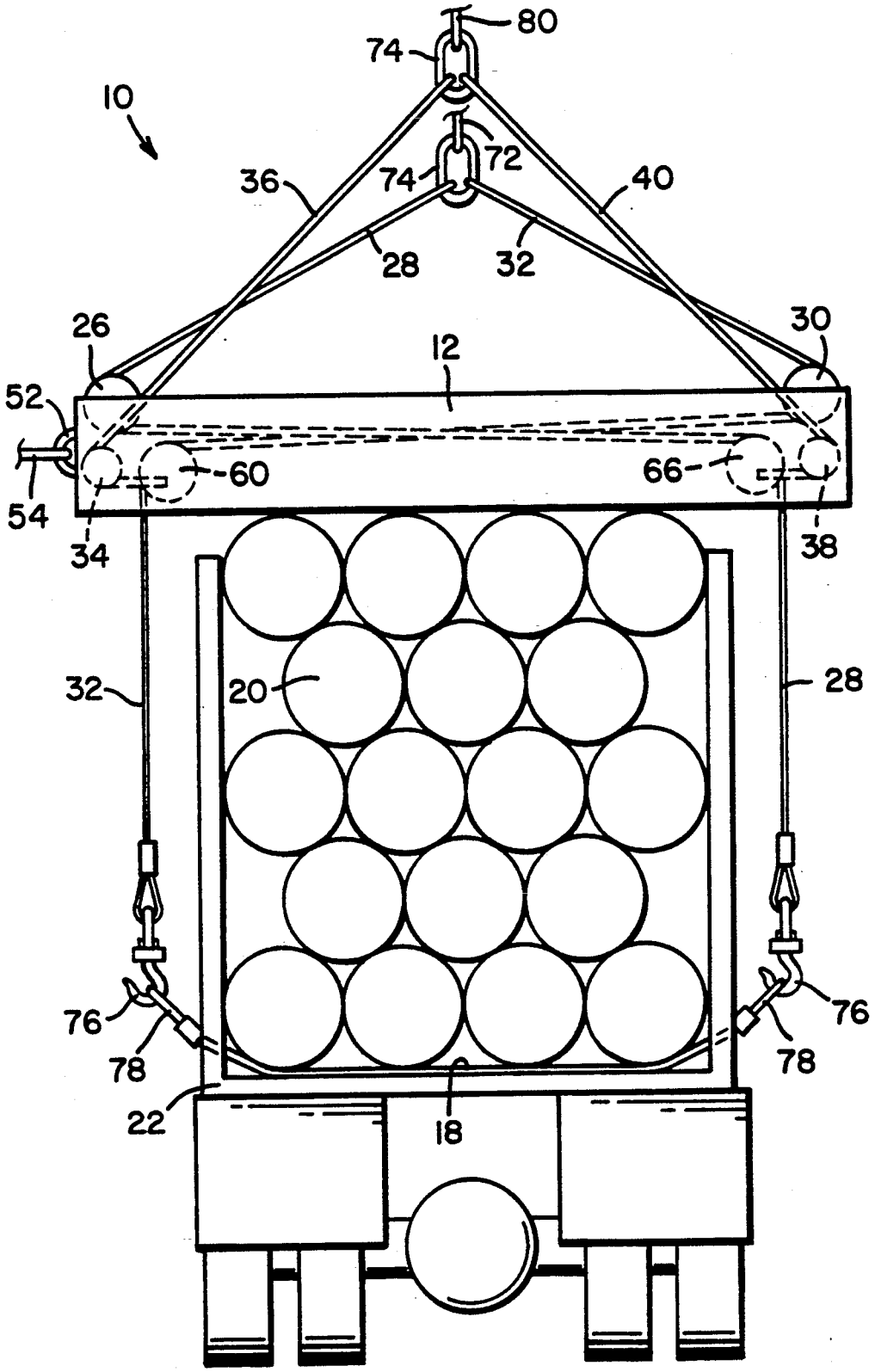
FIG. 1 illustrates the unloading position of the log lifting beam assembly according to the preferred embodiment of the invention, wherein the trolley systems are positioned proximate the outer end portions of the elongated beam and the branches of the hoisting sling are secured to the ends of the pulp sling.

Referring now specifically to the drawings, the log lifting beam assembly of the present invention, generally designated as 10, includes an elongated beam 12, containing first and second longitudinally displaceable trolley systems 14 and 16, respectively, for securing a cable pulp sling 18 against the bottom of a tier of logs 20 carried by a truck 22.

As illustrated in FIGS. 1–5, the elongated beam 12 includes longitudinally extending trolley guides 24 on opposing inner sides thereof for movably receiving the trolley systems 14 and 16, a first vertically oriented hoisting sheave 26 located proximate a first end thereof for receiving a first branch of a hoisting sling 28, a second vertically oriented hoisting sheave 30 located proximate a second opposite end thereof for receiving a second branch of the hoisting sling 32, a first vertically oriented release sheave 34 for receiving a first branch of a release sling 36, a second vertically oriented release sheave 38 for receiving a second branch of the release sling 40, a first horizontally oriented equalizing sheave 42 located proximate the first end of the beam for receiving a first trolley displacement equalizing cable 44, a second horizontally oriented equalizing sheave 46 located proximate the second end of the beam for receiving a second trolley displacement equalizing cable 48, stop elements 50 for controlling the oppositely directed outward longitudinal displacement of the trolley systems along the beam, and a tag line fastening element 52 for securing a crane operated tag line 54 thereto. In addition, each of the longitudinally extending trolley guides 24 may include a longitudinally extending, inwardly projecting vertical wheel stop 25 for controlling the vertical displacement of the trolley systems within the elongated beam.

The first trolley system 14 includes a frame 56, a plurality of side mounted wheels 58 which are designed to rotate along the guides 24 within the elongated beam 12, a vertically oriented trolley sheave 60 for receiving the second branch of the hoisting sling thereover 32, a securing element 62 for operatively attaching a first end of the first trolley displacement equalizing cable 44 thereto, a securing element 64 for operatively attaching a first end of the second trolley displacement equalizing cable 48 thereto and means for securing the first branch of the release sling 36 thereto (not shown). Similarly, the second trolley system 16 includes a frame 56, a plurality of side mounted wheels 58, a vertically oriented trolley sheave 66 for receiving the first branch of the hoisting sling 28 thereover, a securing element 68 for operatively attaching a second end of the first trolley displacement equalizing cable 44 thereto, a securing element 70 for operatively attaching a second end of the second trolley displacement equalizing cable 48 thereto and means for securing the second branch of the release sling 40 thereto (not shown).

Figure 3:
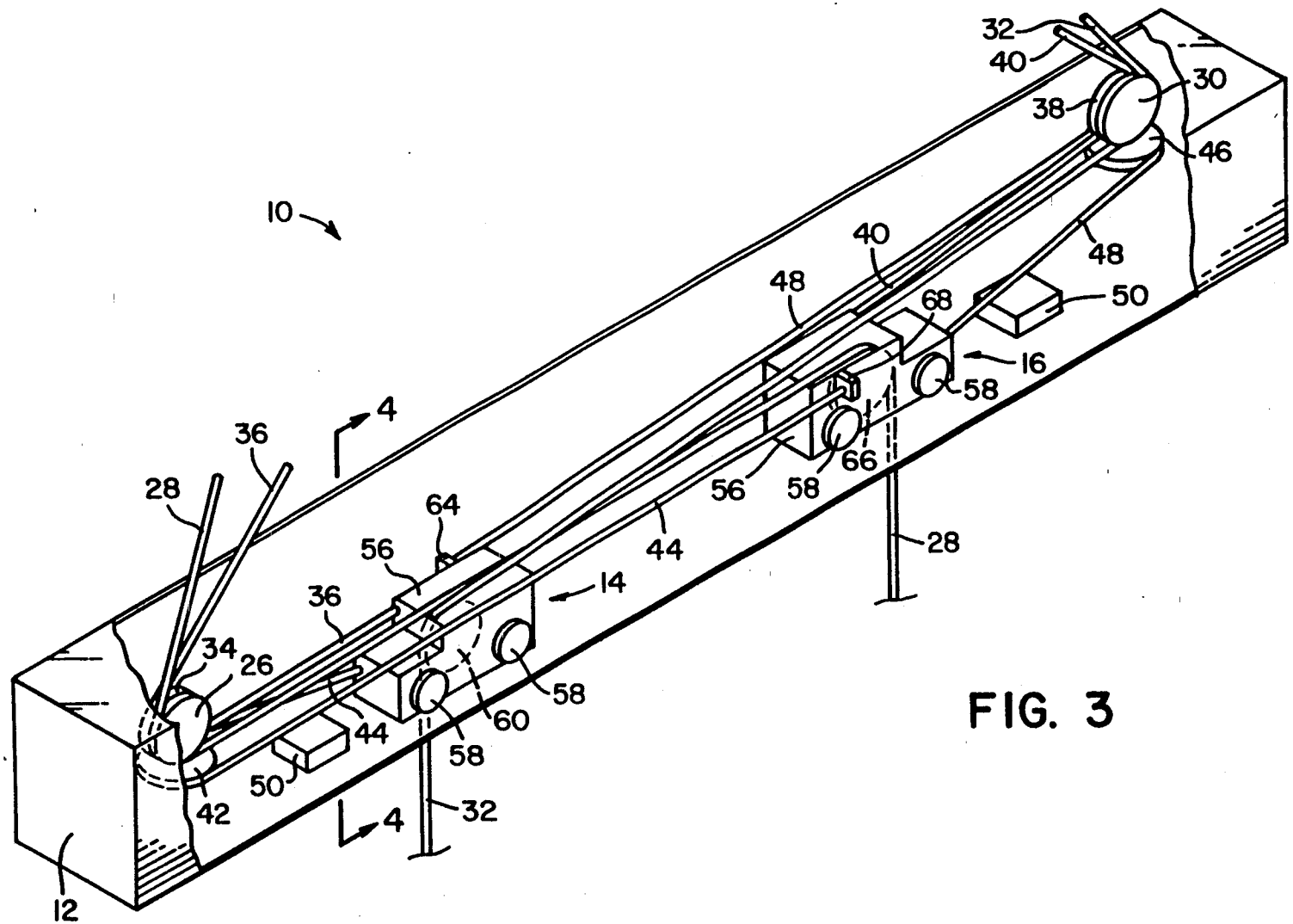
FIG. 3 is a perspective cut-away view of the log lifting beam assembly.
Figure 4:
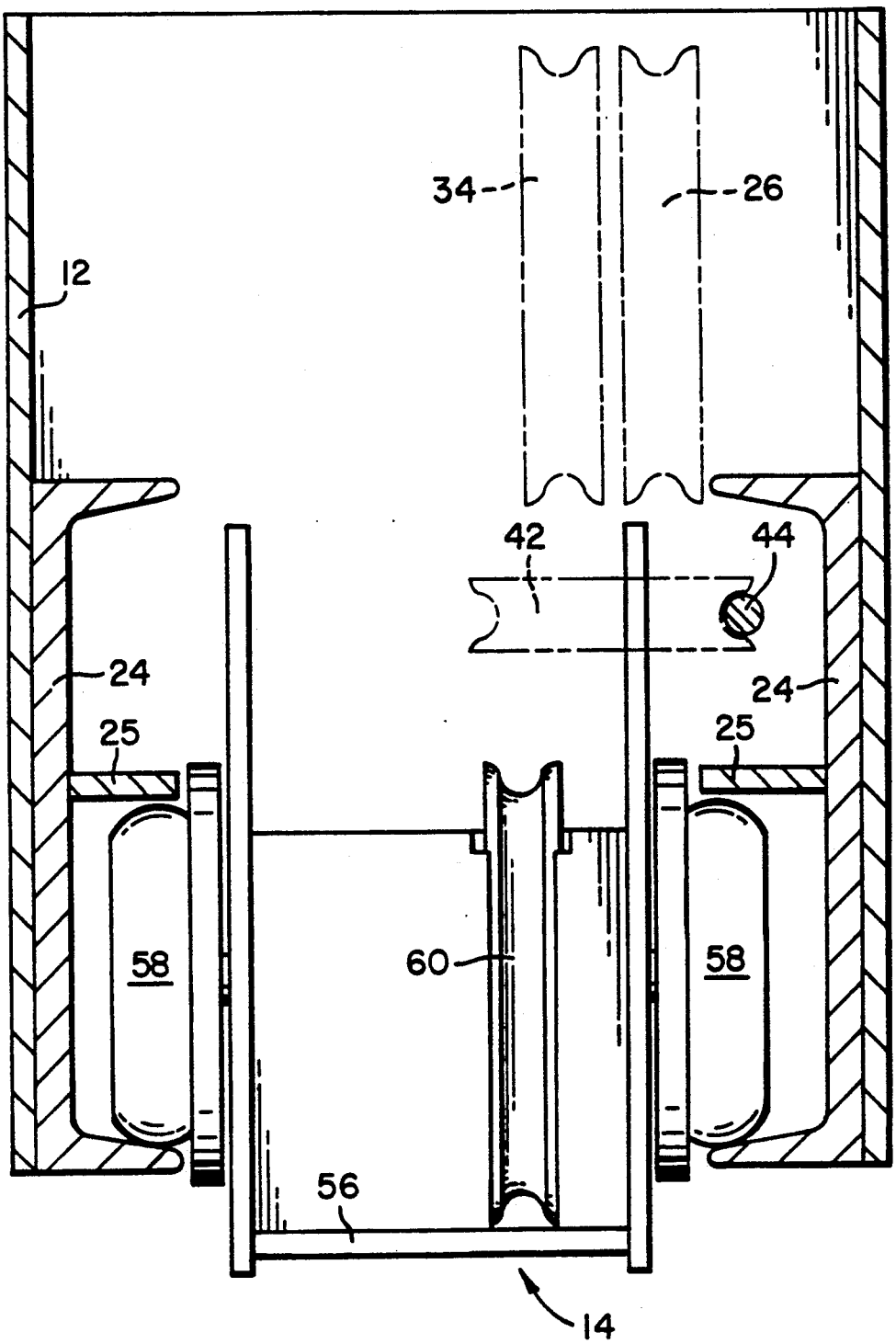
FIG. 4 is a partial cross-sectional view of the beam assembly taken along line 4—4 of FIG. 3.
Figure 5:
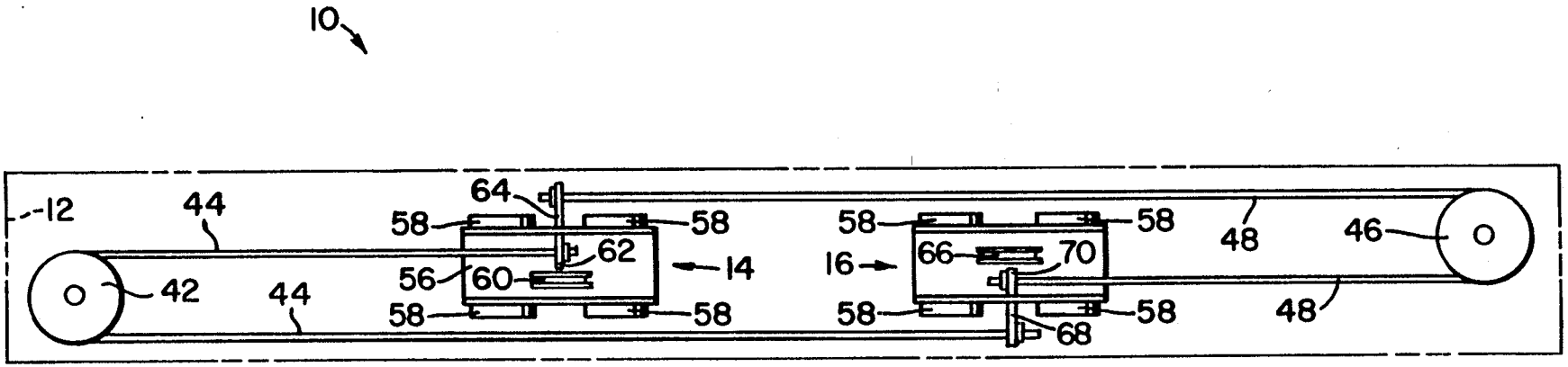
FIG. 5 is a cut-away plan view of the trolley displacement equalizing system.

Referring now to FIGS. 3–5, the relative transverse locations of the hoisting, release, trolley and equalizing sheaves within the elongated beam 12 have been chosen in order to prevent the crane operated hoisting and release cables, the branches of the hoisting sling, the branches of the release sling, and the equalizing cables from entangling and/or damaging each other during the operation of the beam assembly, although many other possible configurations may be utilized.

Figure 2:
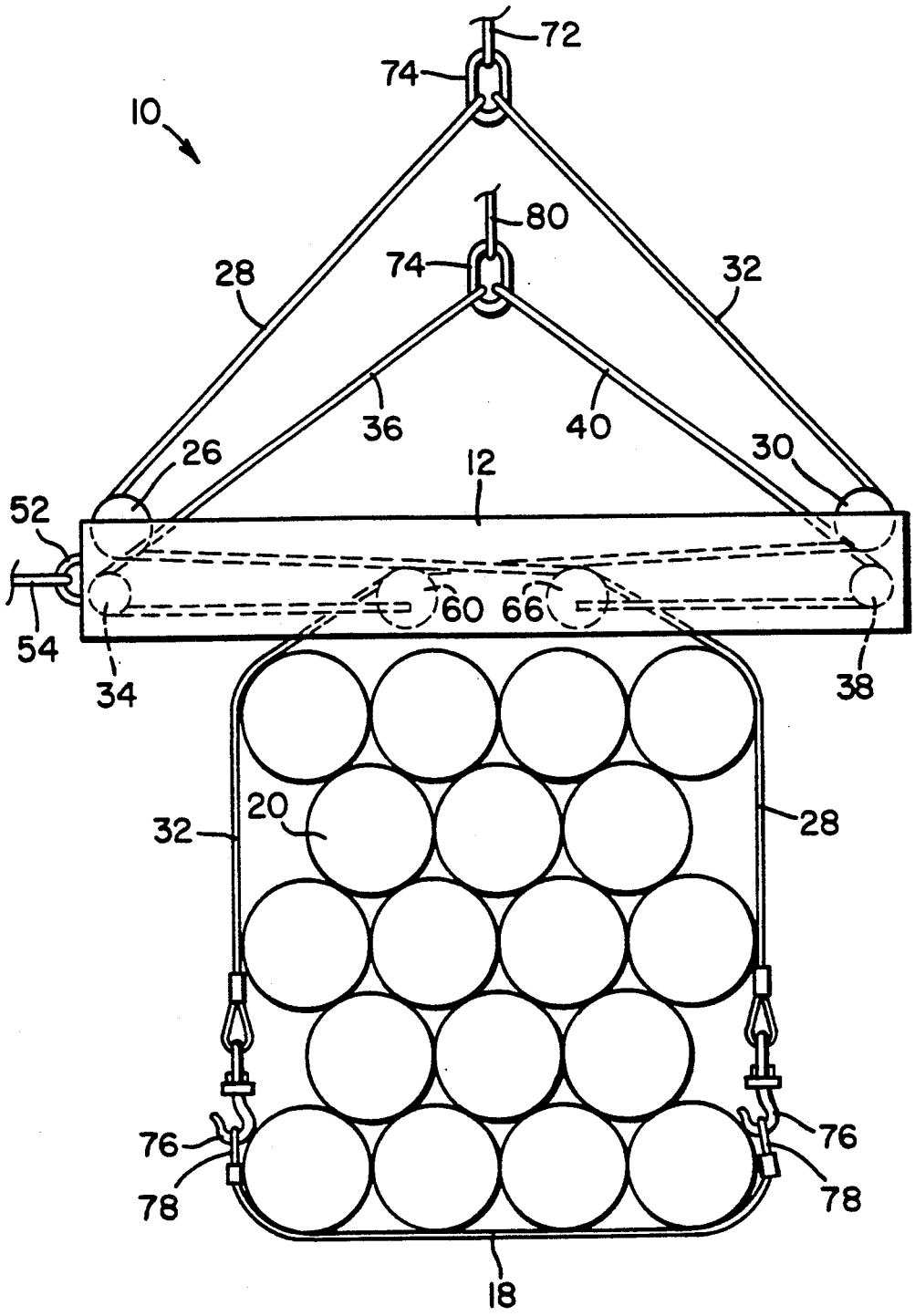
FIG. 2 illustrates the operational position of the log lifting beam assembly, wherein the pulp sling is tightened against the lower section of a tier of logs and the trolley systems are positioned proximate the center of the elongated beam.

As illustrated in FIGS. 1–3, the branches of the hoisting sling 28 and 32 are operatively connected to a crane operated hoisting cable 72 by an oblong link 74. The first branch of the hoisting sling 28 runs under the first hoisting sheave 26, travels through the beam 12, runs over the trolley sheave 66 on the second trolley system 16, passes out through the bottom of beam, and hangs down one side of the truck 22 proximate a lower portion thereof. Correspondingly, the second branch of the hoisting cable 32 runs under the second hoisting sheave 30, travels through the beam 12 in a direction substantially opposite to that of the first branch of the hoisting sling 28, runs over the trolley sheave 60 located on the first trolley system 14, passes out through the bottom of the beam, and hangs down the other side of the truck. The lower end of each branch of the hoisting sling includes a hook-type element 76 which is adapted to be secured to a loop or other appropriate securing component 78 located on opposite ends of the pulp sling 18. As illustrated in FIGS. 1 and 2, the hook-type elements 76 are positioned far enough down the sides of the truck so that they may be easily coupled to opposing ends of the pulp sling 18 by workmen standing on the ground.

The branches of the release sling 36 and 40 may be operatively connected to a crane operated release cable 80 by any suitable hardware such as an oblong link 74. The first branch of the release sling 36 runs under the first release sheave 34 and is operatively secured to the first trolley system 14 by any appropriate means. Similarly, the second branch of the release sling 40 runs under the second release sheave and is operatively secured to the second trolley system 16.

As illustrated in detail in FIGS. 3 and 5, the present invention utilizes a trolley displacement equalizing system to control the relative displacement of the first and second trolley systems along the elongated beam 12.

The equalizing system includes the first and second horizontally oriented equalizing sheaves 42 and 46, respectively, and the first and second trolley displacement equalizing cables 44 and 48, respectively. In particular, the first equalizing cable 44 is fastened to the securing element 62 on the first trolley system 14, runs around the first equalizing sheave 42 and is fastened to the securing element 68 on the second trolley system 16. Similarly, the second equalizing cable 48 is fastened to the securing element 64 on the first trolley system, runs around the second equalizing sheave 46, and is fastened to the securing element 70 on the second trolley system. In operation, the displacement of one of the trolley systems in response to the manipulation of the crane operated hoisting and release cables 72 and 80, respectively, results in a substantially equivalent but oppositely directed displacement of the other trolley system, thus ensuring that the trolley systems will travel longitudinally inward and outward substantially in unison along the elongated beam, thereby maintaining the log lifting beam assembly in a substantially horizontal operational orientation.

During the positioning of the log lifting beam assembly 10 of the present invention over the tier of logs 20 and the corresponding pulp sling 18, a crane operator supports the weight of the beam on the crane operated release cable 80, thereby pulling the first and second branches of the release sling upward and outwardly displacing the first and second trolley systems against the stop elements 50 located proximate each end of the elongated beam 12. After the beam assembly has been correctly positioned against the top of the tier of logs, the crane operator lowers the crane operated hoisting cable 72, thereby lowering the first and second branches of the hoisting sling 28 and 32, respectively, down opposite sides of the truck, wherein the hook-type elements 76 on each end thereof may be secured to the loops 78 on each end of the pulp sling 18 by workmen standing on the round. Following the securement of the pulp sling 18 to the branches of the hoisting sling, the crane operator elevates the crane operated hoisting cable 72 while disengaging the release cable 80, thereby applying an inwardly directed pressure against the first and second trolley systems, tightening the attached pulp sling 18 and the branches of the hoisting sling 28 and 32 against the tier of logs 20 and clamping the logs against the bottom of the elongated beam 12. Specifically, as the beam assembly 10 is lifted in response to the upward movement of the release cable 80, the weight of the tier of logs against the pulp sling 18 forces the first branch of the hoisting sling 28 against an outer portion of the trolley sheave 66 located on the second trolley system 16 and forces the second branch of the hoisting sling 32 against an outer portion of the trolley sheave 60 located on the first trolley system 14, thereby applying an inwardly directed pressure thereagainst which propels the trolley systems toward each other along the longitudinally extending guides 24 within the elongated beam 12. After the log lifting beam assembly 10 has been correctly positioned over an appropriate area of the wood yard, the crane operator may release the logs by elevating the crane operated release cable 80 while increasing the slack of the crane operated hoisting cable 72, thereby pulling the first and second trolley systems toward opposing ends of the elongated beam 12 and reducing the clamping force exerted against the bottom, sides and top of the tier of logs by the pulp sling 18, first and second branches of the hoisting sling 28 and 32 and the bottom of the elongated beam 12, respectively.

The foregoing description of the preferred embodiments of the invention has been presented for purposes of illustration and description. It is not intended to be exhaustive or to limit the invention to the precise form disclosed, and obviously many modifications and variations are possible in light of the above teaching. Such modifications and variations that may be apparent to a person skilled in the art are intended to be included within the scope of this invention as defined by the accompanying claims. For example, the log lifting beam assembly may include hydraulic and/or motorized systems for longitudinally displacing the trolley systems along the elongated beam.

I claim:

1. An apparatus for unloading a tier of logs from a truck comprising:

sling means for receiving said tier of logs, wherein said sling means is adapted to be transversely positioned under said tier of logs;

a beam assembly including first and second longitudinally displaceable trolley systems, wherein said beam assembly is adapted to be transversely positioned over said tier of logs with a first end portion of said sling means coupled to said first longitudinally displaceable trolley system, and a second, opposing end portion of said sling means coupled to said second longitudinally displaceable trolley system; and means, operatively connected to said sling means, for controlling the longitudinal displacement of said first and second trolley systems along said beam assembly, wherein said sling means is secured against said tier of logs or is released from against said tier of logs in response to the relative longitudinal displacement of said first and second trolley systems along said beam assembly.

2. The apparatus of claim 1 wherein said sling means is secured against said tier of logs in response to the inwardly directed longitudinal displacement of said first and second trolley systems, said first and second trolley systems being displaced toward each other along said beam assembly.

3. The apparatus of claim 2 wherein said sling means is released from against said tier of logs in response to the outwardly directed longitudinal displacement of said first and second trolley systems, said first and second trolley systems being displaced away from each other along said beam assembly.

4. An apparatus for unloading a tier of logs from a truck comprising:

sling means for receiving said tier of logs, wherein said sling means is adapted to be transversely positioned under said tier of logs;

a beam assembly including first and second longitudinally displaceable trolley systems, wherein said beam assembly is adapted to be transversely positioned over said tier of logs; and means, operatively connected to said sling means, for controlling the longitudinal displacement of said first and second trolley systems along said beam assembly, wherein said sling means is secured against said tier of logs or is released from against said tier of logs in response to the relative longitudinal displacement of said first and second trolley systems along said beam assembly, said means for controlling the longitudinal displacement of said first and second trolley systems including a hoisting cable means and a release cable means.

5. The apparatus of claim 4 further including a lifting means for controlling said hoisting cable means and said release cable means and for positioning said beam assembly proximate said tier of logs.

6. The apparatus of claim 5 wherein said hoisting cable means includes first and second sections which are adapted to be operatively connected to opposing end portions of said sling means.

7. The apparatus of claim 6 wherein said first and second trolley systems each include sheave means for receiving one of said sections of said hoisting cable means.

8. The apparatus of claim 7 wherein the first section of said hoisting cable is received by the sheave means on one of said trolley systems and is operatively connected to a first end portion of said sling means.

9. The apparatus of claim 8 wherein the second section of said hoisting cable is received by the sheave means on the other of said trolley systems and is operatively connected to a second end portion of said sling means, opposite the first end portion.

10. The apparatus of claim 9 wherein said first and second trolley systems are adapted to be inwardly displaced toward each other along said beam assembly in response to said hoisting cable means, thereby tightening the first and second sections of the hoisting cable means against opposing sides of said tier of logs, tightening the sling means against the lower portion of the tier of logs and positioning the top portion of the tier of logs proximate the bottom of the beam assembly.

11. The apparatus of claim 5 wherein said release cable means includes first and second sections which are adapted to be operatively connected to said first and second trolley systems, respectively.

12. The apparatus of claim 11 wherein said first and second trolley systems are adapted to be outwardly displaced away from each other along said beam assembly in response to said release cable means, thereby loosening the sling means from against the tier of logs and allowing the logs to be released.

13. An apparatus for unloading a tier of logs from a truck comprising:

sling means for receiving said tier of logs, wherein said sling means is adapted to be transversely positioned under said tier of logs;

a beam assembly including first and second longitudinally displaceable trolley systems, wherein said beam assembly is adapted to be transversely positioned over said tier of logs;

means, operatively connected to said sling means, for controlling the longitudinal displacement of said first and second trolley systems along said beam assembly, wherein said sling means is secured against said tier of logs or is released from against said tier of logs in response to the relative longitudinal displacement of said first and second trolley systems along said beam assembly; and means for coupling said first and second trolley systems, wherein the longitudinal displacement of one of said trolley systems results in a substantially simultaneous longitudinal displacement of the other one of said trolley systems.

14. The apparatus of claim 13 wherein an inwardly directed longitudinal displacement of one of said trolley systems results in a substantially equivalent inwardly directed longitudinal displacement of the other one of said trolley systems.

15. The apparatus of claim 13 wherein an outwardly directed longitudinal displacement of one of said trolley systems results in a substantially equivalent outwardly directed longitudinal displacement of the other one of said trolley systems.

16. The apparatus of claim 13 wherein said coupling means includes:

first and second coupling cable means for interconnecting said first and second trolley systems; and first and second coupling sheave means for receiving a different one of said coupling cable means.

17. An apparatus for unloading a tier of logs from a truck comprising:

sling means for receiving said tier of logs, wherein said sling means is adapted to be transversely positioned under said tier of logs;

a beam assembly including first and second longitudinally displaceable trolley systems, wherein said beam assembly is adapted to be transversely positioned over said tier of logs; and means, operatively connected to said sling means, for controlling the longitudinal displacement of said first and second trolley systems along said beam assembly, wherein said sling means is secured against said tier of logs or is released from against said tier of logs in response to the relative longitudinal displacement of said first and second trolley systems along said beam assembly, said sling means being secured against said tier of logs in response to the inwardly directed longitudinal displacement of said first and second trolley systems, said first and second trolley systems being displaced toward each other along said beam assembly.

18. The apparatus of claim 17 wherein said sling means is released from against said tier of logs in response to the outwardly directed longitudinal displacement of said first and second trolley systems, said first and second trolley systems being displaced away from each other along said beam assembly.

19. An apparatus for unloading a tier of logs from a truck comprising:

sling means for receiving said tier of logs, wherein said sling means is adapted to be transversely positioned under said tier of logs;

a beam assembly including first and second longitudinally displaceable trolley systems, wherein said beam assembly is adapted to be transversely positioned over said tier of logs;

means, operatively connected to said sling means, for controlling the longitudinal displacement of said first and second trolley systems along said beam assembly, wherein said sling means is secured against said tier of logs or is released from against said tier of logs in response to the relative longitudinal displacement of said first and second trolley systems along said beam assembly; and means for lifting said beam assembly and said tier of logs after said sling means has been secured thereagainst, thereby unloading said tier of logs from said truck.

* * * * *